US006554633B1

(12) United States Patent
Nobuyuki et al.

(10) Patent No.: US 6,554,633 B1
(45) Date of Patent: Apr. 29, 2003

(54) ELECTRICAL CONTACT FOR ZIF SOCKET CONNECTOR

(75) Inventors: Hasegawa Nobuyuki, Tu-Chen (TW); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,685

(22) Filed: Dec. 27, 2001

(51) Int. Cl.[7] ..... H01R 13/265
(52) U.S. Cl. ..... 439/342; 439/259; 439/857
(58) Field of Search ..... 439/342, 857, 439/71, 259, 261, 263, 266

(56) References Cited

U.S. PATENT DOCUMENTS 4,498,725 A * 2/1985 Bright et al. ..... 339/176
6,319,038 B1 * 11/2001 Howell et al. ..... 439/342

* cited by examiner

*Primary Examiner*—Tho D. Ta
*Assistant Examiner*—Alexander Gilman
(74) *Attorney, Agent, or Firm*—Wei Te Chung

(57) ABSTRACT

A ZIF socket connector (20) includes a base (22), a cover (24), an actuator (26) and a number of electrical contacts (30). The cover is movably assembled to the base and the base defines a plurality of openings (221) extending therethrough to receive the electrical contacts. Each electrical contact has a base portion (31), a solder portion (32) extending from the base portion, and a contacting portion (34) having a pair of arms (35). Each arm has a descending section (350), a horizontal section (351) extending from the descending section and a resilient section (352) extending from the horizontal section. The resilient sections of each electrical contact have free ends so twisted as to press therebetween and electrically contact a corresponding pin (42) of an electronic package (40).

7 Claims, 9 Drawing Sheets

ELECTRICAL CONTACT FOR ZIF SOCKET CONNECTOR

BACKGROUND OF THE INVENTION

1. Field of the Invention

The present invention relates to an electrical connector, and particularly to a Zero Insertion Force (ZIF) socket connector for interconnecting an electronic package, for example a Central Processing Unit (CPU), with a printed circuit board, for example a mother board.

2. Description of the Related Art

Referring to FIGS. 9–10, two drawing figures substantially adopted from U.S. Pat. No. 4,498,725, an electrical contact 14 to be used in a ZIF socket connector is disclosed. The electrical contact 14 includes two parallel, vertical arms 106 and 108. Channel-shaped strap 110 joins the two arms adjacent their lower ends 112 and spaces them apart. The width of the arms 106 and 108 decrease uniformly upwardly towards their upper ends 116. A pair of fingers 118 project laterally from their attachment to upper ends 116 of the arms 106 and 108. First sections 120 of the fingers 118 converge toward each other. Free ends 122, attached to and extending outward from the converging sections 120, are parallel to each other and are spaced apart by a distance less than the minimum diameter of pins (or leads, see FIG. 11) 117 on an electronic package (not shown) to reliably and electrically connect with the pins 117 when engaged. A lead 124 extends downwardly from the arm 106.

The contacts 14 are stamped out of coplanar stock in a continuous strip. Referring to FIG. 10, a carrier strip 130 is connected to the electrical contact 14 which has not yet been formed into the FIG. 9 structure. A lateral dimension p is defined between outer ends of the fingers 118 of each electrical contact 14, which determines a minimal length of material needed to make an electrical contact 14. Since the arms 106, 108 with the fingers 118 are symmetrically configured with respect to each other, as is known to one of ordinary skill in the pertinent art, for providing dual contacting points to the pins 117 of the electronic package to ensure an electrical connection therebetween, the lateral dimension p is twice of the lateral dimension p' of each arm 106, 108, which is defined between a center line C of the electrical contact 14 and the outer end of the finger 118, and is comparatively large, thereby consuming a large quantity of material in manufacturing and increasing the cost of the electrical contacts 14, which is obviously not economical to contact manufacturers.

In addition, a pitch p" is defined between the center lines C of every two adjacent electrical contacts 14 and is comparatively large due to the relatively large lateral dimension p of each electrical contact 14, thereby decreasing the efficiency in both the plating process of the electrical contacts and the assembling process of the electrical contacts to a corresponding insulative housing (not shown).

Furthermore, referring to FIG. 11, as is known to persons skilled in the pertinent art, after the pin 117 is initially inserted between the fingers 118 with zero insertion force, the pin 117 is then pushed to electrically contact with the free ends 122 and the free ends 122 and the converging sections 120 of the arms 106, 108 are slightly pressed outwardly around a beginning portion 109 from which the converging sections 120 begin to converge toward each other. A total length of each finger 118 is relatively small, so an arm of force, which is defined between the beginning portion 109 and the outer end of the finger 118, is also small, thereby resulting in an undesirably large push force for the pin into between the free ends 122.

Furthermore, when the pin 117 is pushed, in the direction as indicated by the arrow B, from between the converging sections 120 to between the free ends 122, acute angles formed between the converging sections 120 and the free ends 122 is encountered since a distance between the converging sections 120 is larger than a distance between the free ends 122, thereby further increasing the push force.

Therefore, an improved electrical contact for a ZIF socket connector is desired.

SUMMARY OF THE INVENTION

An object of the present invention is to provide a cost effective electrical contact for a ZIF socket connector which provides also a reliable electrical connection between an electronic package and a printed circuit board.

Another object of the present invention is to provide an electrical for a ZIF socket connector which increases efficiency of the plating and the assembling processes thereof.

Another object of the present invention is to provide an electrical contact for a ZIF socket connector which reduces a push force needed for a pin of an electronic package to electrically contact therewith.

A ZIF socket connector comprises a base, a cover, an actuator and a plurality of electrical contacts in accordance with the present invention. The cover is assembled to the base and is actuated by the actuator to be movable with respect to the base. The electrical contacts are received in the base. Each electrical contact comprises a base portion, a solder portion extending from the base portion, and a contacting portion comprising a pair of arms. Each arm comprises a vertical section extending from the base portion, a horizontal section and a resilient section having free end. The free ends of the resilient sections of the arms are so formed as to have contacting surfaces thereof press therebetween and electrically contact a pin electronic package received on the cover.

Other objects, advantages and novel features of the invention will become more apparent from the following detailed description of the present embodiment when taken in conjunction with the accompanying drawings.

DETAILED DESCRIPTION OF THE INVENTION

Figure 1:
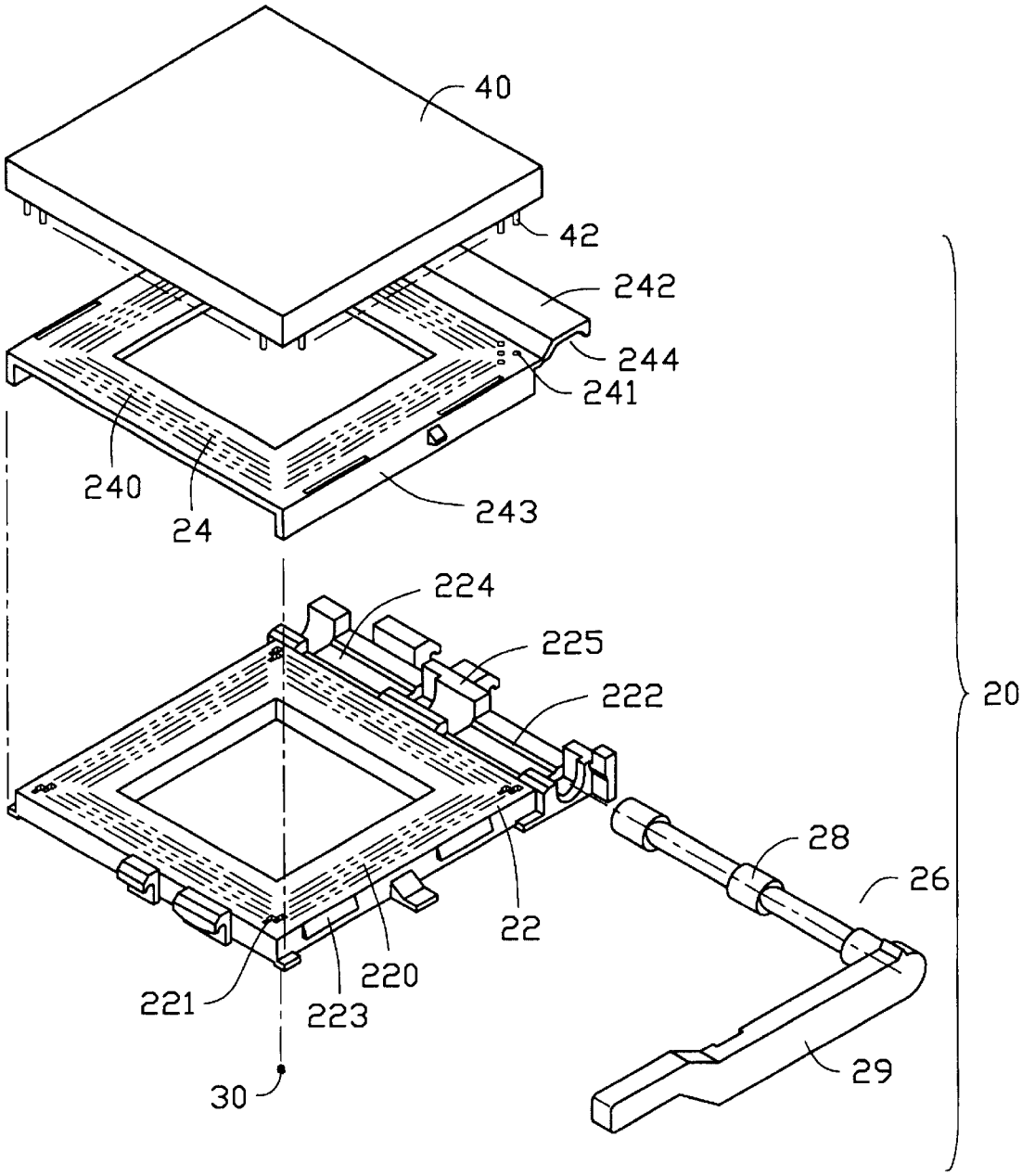
FIG. 1 is an exploded view of a ZIF socket connector employing electrical contacts in accordance with the present invention.
Figure 2:
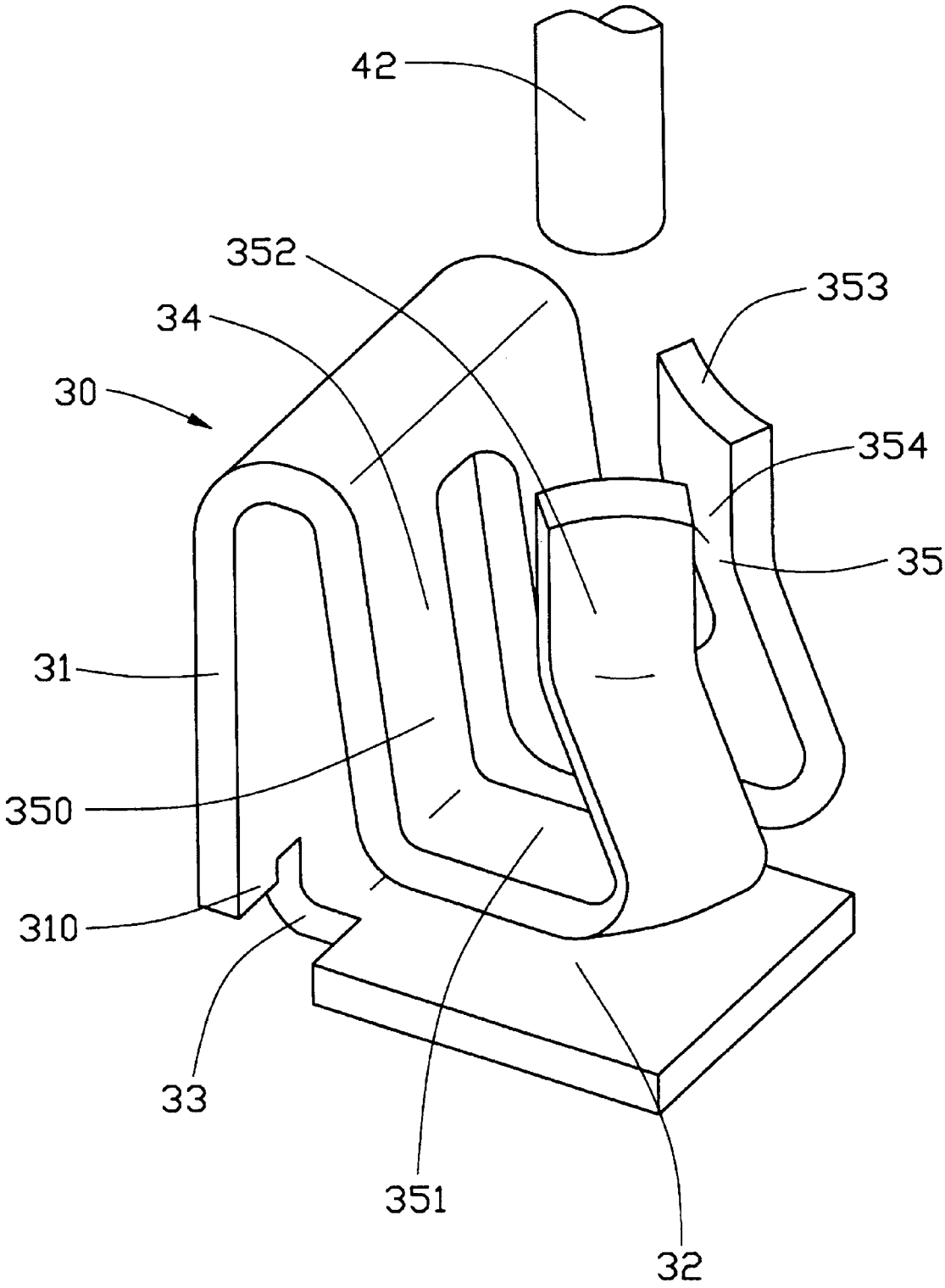
FIG. 2 is a perspective view of the electrical contact of the ZIF socket connector of FIG. 2 with a pin of an electronic package being shown thereabove.
Figure 3:
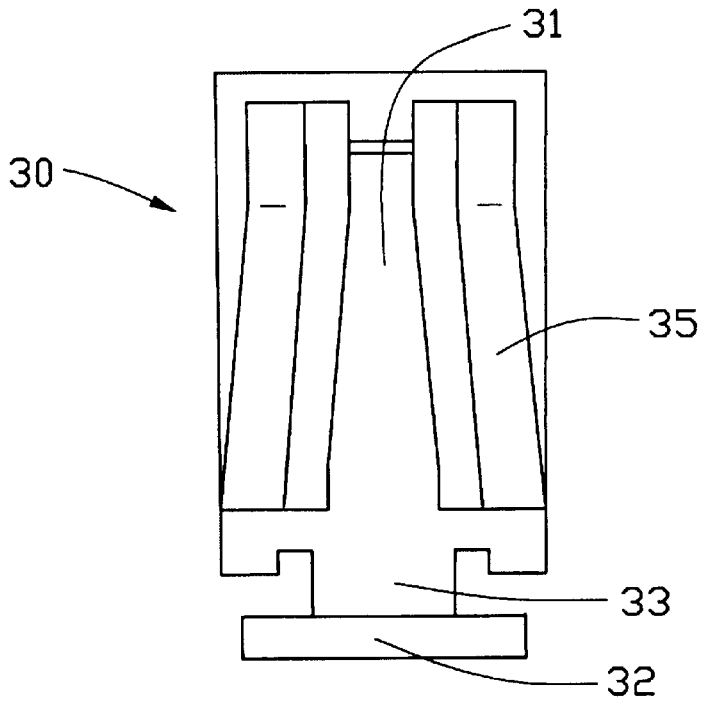
FIG. 3 is a front view of the electrical contact of the ZIF socket connector of FIG. 1.
Figure 4:
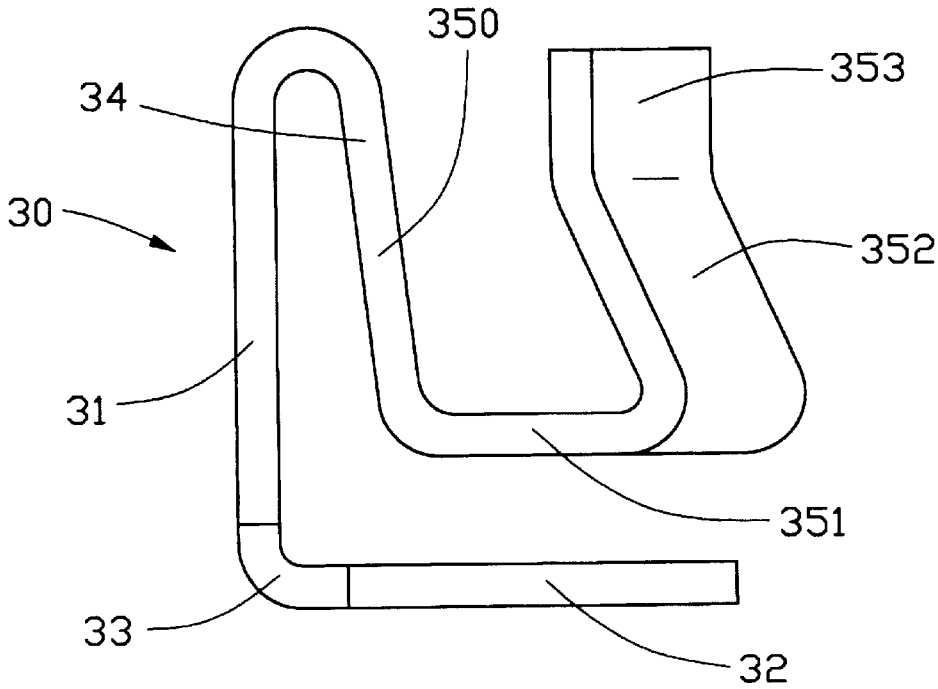
FIG. 4 is a side elevational view of FIG. 3.
Figure 5:
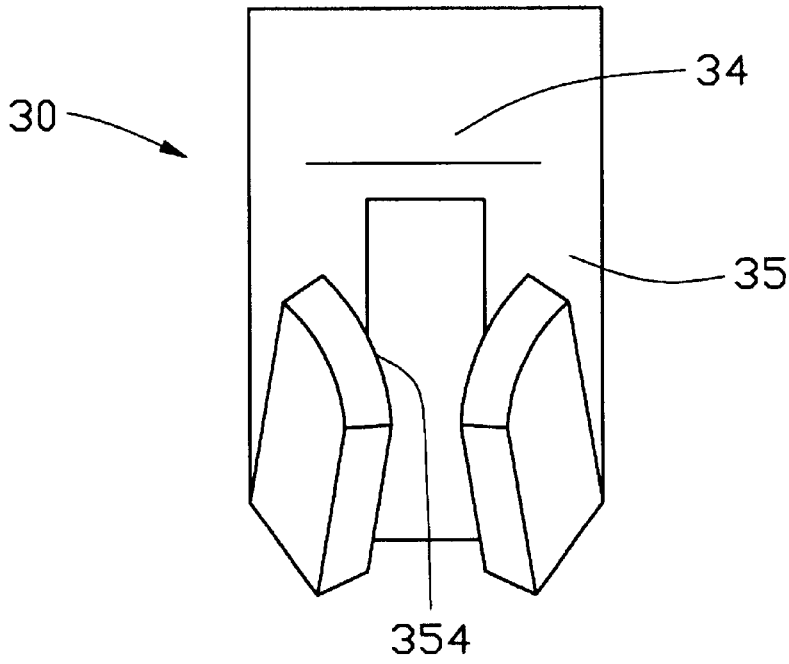
FIG. 5 is a top plan view of FIG. 3.

Referring to FIG. 1, a ZIF socket connector 20 is to electrically an electronic package 40 having a plurality of pins (leads) 42 extending downwardly with a printed circuit board (not shown). The ZIF socket connector 20 comprises a base 22, a cover 24, an actuator 26 and a plurality of electrical contacts 30 in accordance with the present invention.

The base 22 is generally rectangular in shape and includes a rectangular base frame 220 and an actuator accommodating portion 222 on a side of the base frame 220. The base frame 220 is formed with a plurality of openings 221 extending therethrough for receiving the electrical contacts 30 therein and a plurality of protrusions 223 extending outwardly from outer surfaces thereof. The actuator accommodating portion 222 defines a slot 224 and a plurality of blocks 225 beside the slot 224.

The cover 24 is to assemble with the base 22 and has a rectangular cover frame 240 and an actuator accommodating portion 242 on a side of the cover frame 240. The cover frame 240 and the actuator accommodating portion 242 align with the base frame 220 and the actuator accommodating portion 222 of the base 22, respectively. The cover frame 240 comprises a plurality of holes 241 extending therethrough and corresponding in number to the electrical contacts 30 received in the openings 221, a pair of flanges 243 extending downwardly, and a plurality of recesses (not shown) defined in inner surfaces of the flanges 243. The recesses of the cover frame 240 are engageable with the protrusions 223 of the base frame 220 so that the cover 24 is movably assembled to the base 22. The actuator accommodating portion 242 defines a groove 244 in a lower surface thereof and cooperating with the slot 224 to define a channel therebetween.

The actuator 26 comprises a lever 28 received within the channel defined by the slot 224 and the groove 244 and a handle 29 extending perpendicularly from an end of the lever 28. The actuator 26 could be in any other forms, as is known to one of ordinary skill in the pertinent art, used in all kinds of ZIF socket connectors, for example a cam extending in corners of the base and the cover and manipulated by an external tool when used, on the only condition that it could be manipulated to move the cover with respect to the base and it complies with the environment of utilizing, although it is exemplified herein as a lever-handle type.

Referring to FIGS. 2–5, each electrical contact 30 comprises a planar base portion 31, a solder portion 32, a transitional portion 33 between the base and the solder portions 31, 32, and a contacting portion 34. The transitional portion 33 has a width generally smaller than either of the base portion 31 and the solder portion 32 and is generally so configured that the solder portion 32 is substantially perpendicular to the base portion 31. The base portion 31 comprises a pair of barbs 310 extending downwardly from two opposite sides thereof and respectively spaced from an upper section of the transitional portion 33 to retain the electrical contact 30 in the opening 221 of the base 22. The solder portion 32 is shown herein rectangularly planar and is perpendicular to the base portion 31, nevertheless, it could be adapted in any other forms known by one of ordinary skill in the pertinent art to solder the electrical contact 30 to the printed circuit board.

The contacting portion 34 comprises a pair of arms 35 spaced from and generally parallel to each other. Each arm 35 comprises a descending section 350 extending downwardly from an upper section of the base portion 31, a horizontal section 351 extending generally perpendicularly from a lower section of the descending section 350 to be located parallelly above the solder portion 32, a resilient section 352 extending upwardly from a front section of the horizontal section 351 and having a distal free end 353. The descending sections 350 of the two arms 35 are located in a common plane and the horizontal sections 351 of the two arms 35 are located in another common plane. The free ends 353 of the arms 35 are so inwardly and smoothly twisted that contacting surfaces 354 thereof facing toward each other. A distance between the contacting surfaces 354 of the free ends 353 is substantially smaller than a minimum diameter of the pin 42 of the electronic package 40.

Figure 6:
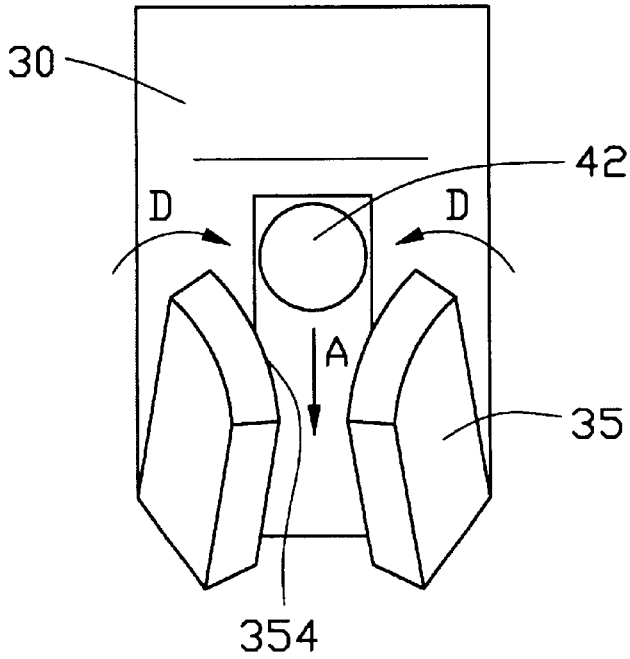
FIG. 6 is a view similar to FIG. 5, showing that the pin of the electronic package is received but not contacted with the electrical contact.

When the electronic package 40 is initially disposed on the cover 24, the pins 42, as is the case with any ZIF socket, extend with zero insertion force through the holes 241 of the cover 24 into the openings 221 of the base 22 without electrically contacting with the electrical contacts 30. Referring to FIG. 6, the pin 42 is located in a space confined by the two arms 35.

Figure 7:
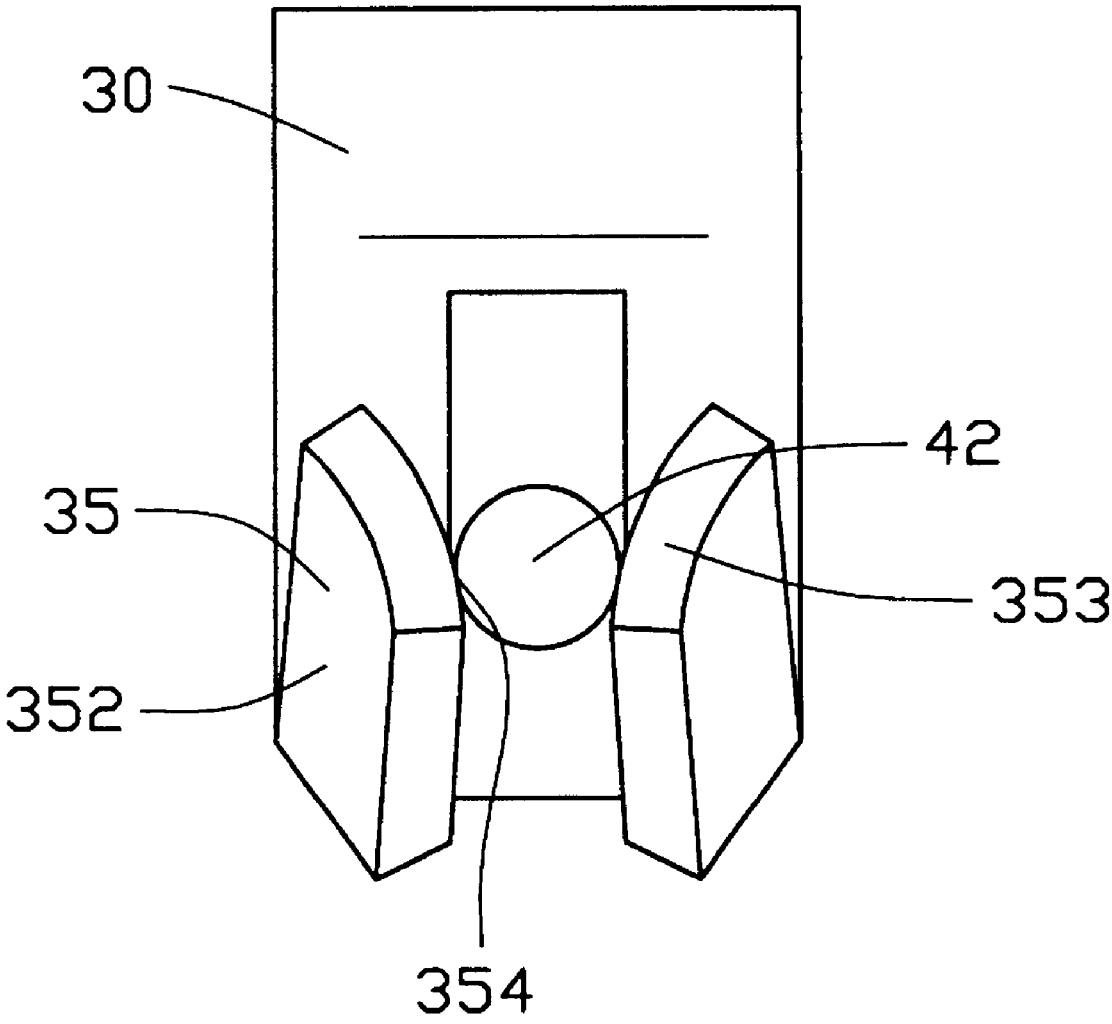
FIG. 7 is a view similar to FIG. 6 but the pin of the electronic package is contacted with the electrical contact.

The cover 24 with the electronic package 40 is then actuated by the cooperation of the blocks 225 of the base 22 and the lever 28 of the actuator 25, which is in turn actuated by the handle 29, to move on the base 22 and to push the pins 42 in the direction as indicated by the arrow A in FIG. 6. Referring to FIG. 7, the pin 42 is finally located between the free ends 353 of the arms 35 and electrically contacts with the contacting faces 354. Since the distance between front sections of the free ends 353 of the arms 35 is substantially smaller than the minimal diameter of the pin 42, the resilient sections 352 are twisted by a torsional force in directions as indicated by the arrows D in FIG. 6, thereby ensuring an electrical connection therebetween, and the pin 42 is reliably pressed between the free ends 353.

Figure 8:
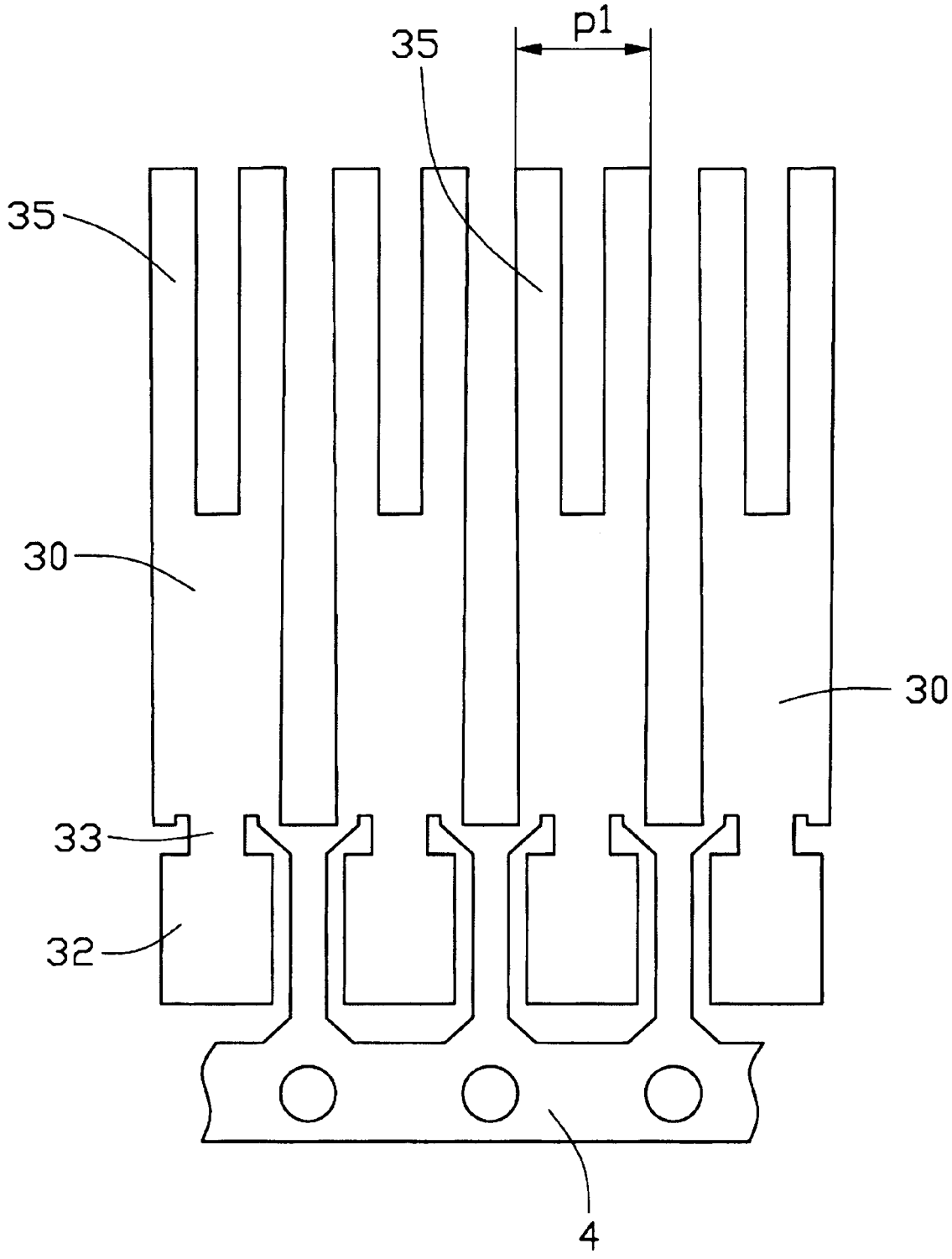
FIG. 8 is a plan view of four electrical contacts prior to forming.
Figure 9:
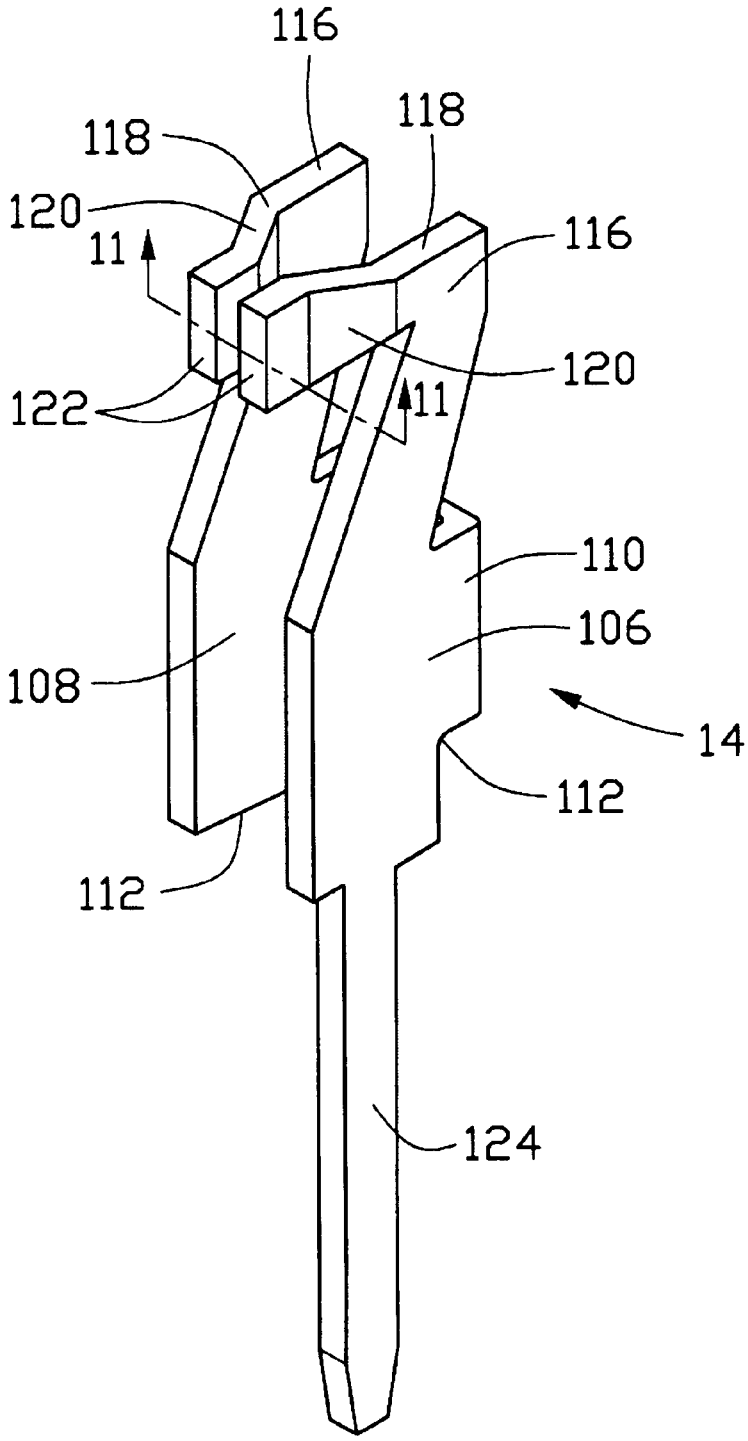
FIG. 9 (PRIOR ART)
FIG. 9 is a perspective view of a prior art electrical contact.
Figure 10:
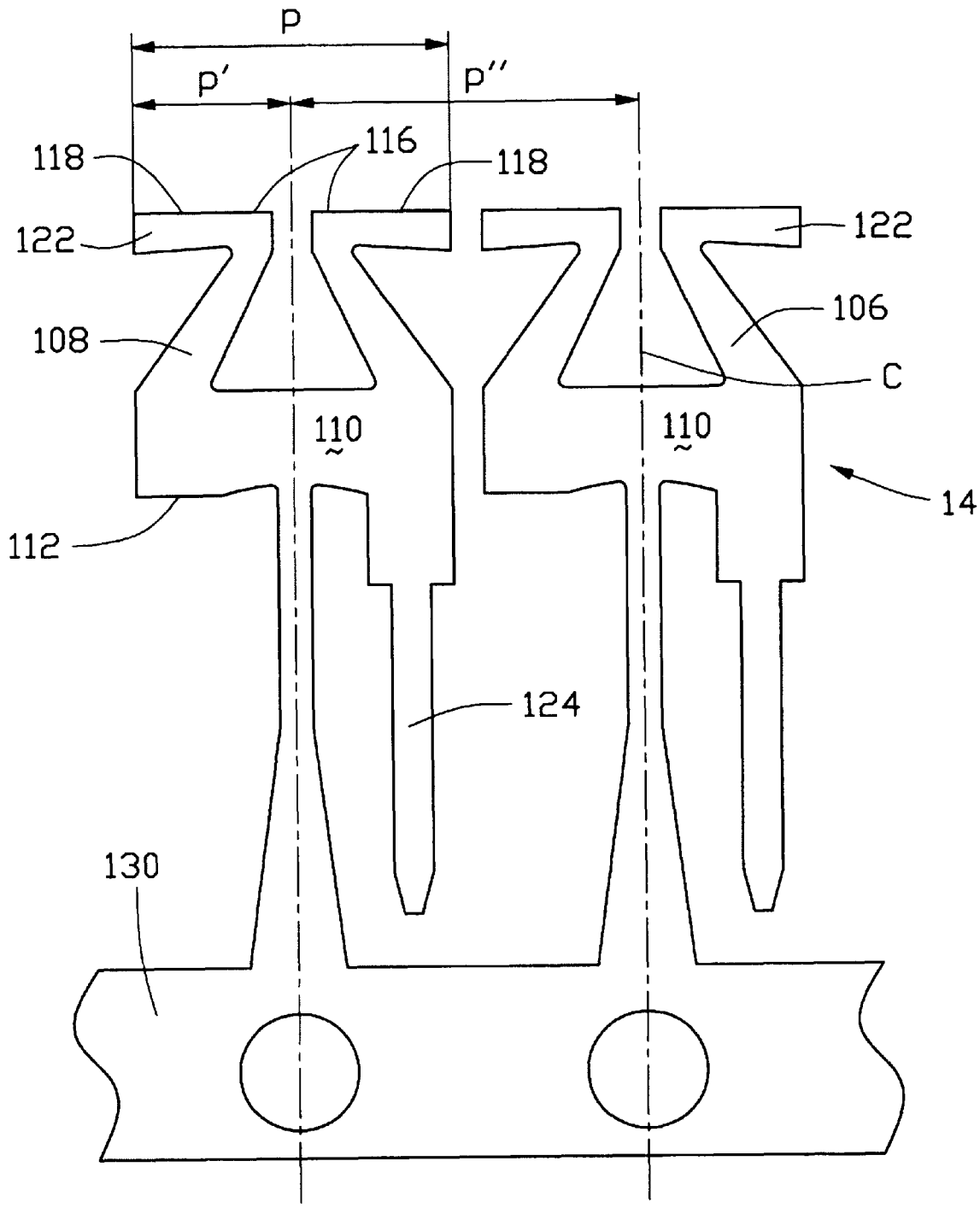
FIG. 10 (PRIOR ART)
FIG. 10 is a plan view of two blanked-out electrical contacts of FIG. 9 prior to being formed.
Figure 11:
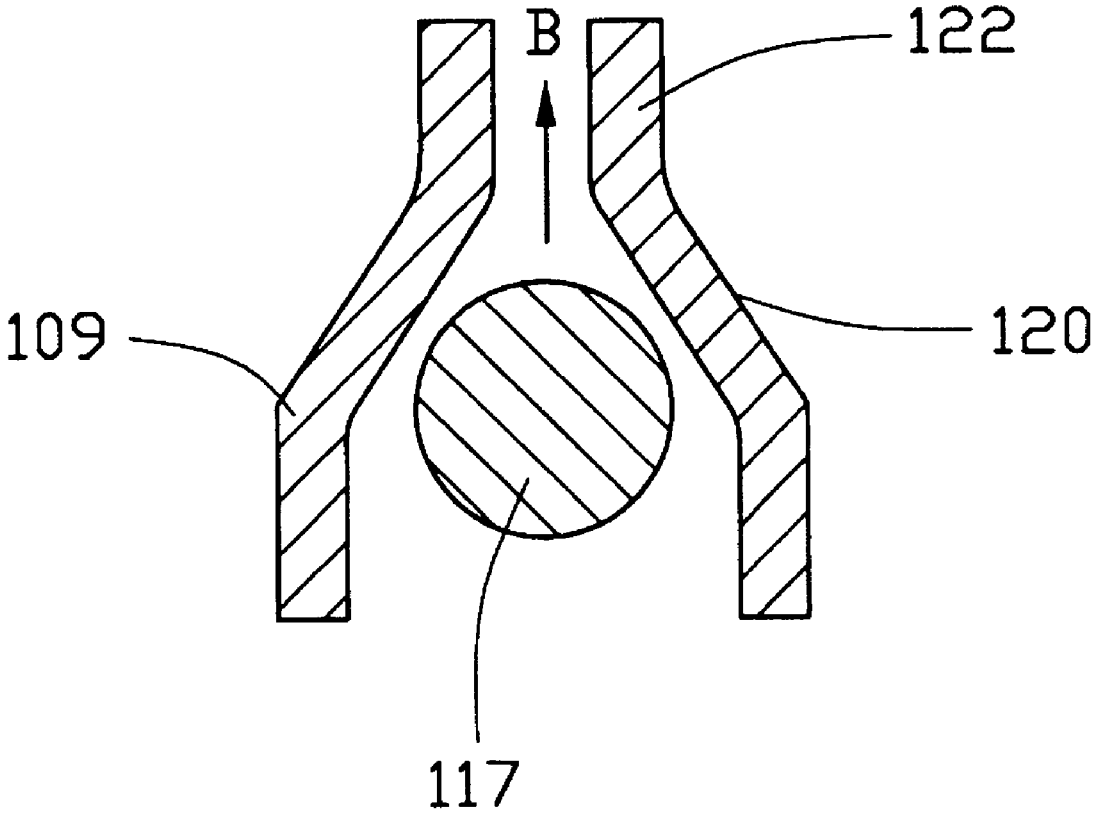
FIG. 11 (PRIOR ART)
FIG. 11 is a cross-section view taken from line 11—11 of FIG. 9.

Referring also to FIG. 8, four electrical contacts 30 prior to forming are as shown connected to a carrier strip 4, a lateral dimension p1 of each electrical contact 30, which is defined between outer ends of the arms 35 and determines a minimum length of material to make an electrical contact 30, is comparatively small since all parts of the electrical contact 30 extend along a longitudinal direction which is perpendicular to a direction along which the carrier strip 4 extends, so the material from which the electrical contact 30 is made is saved and the manufacturing cost thereof is reduced.

The arms 35 of each electrical contact 30 all extend in the longitudinal direction, so a pitch between center lines of every two adjacent electrical contacts 30 is also comparatively reduced, thereby increasing the efficiency of plating process of the electrical contacts 30 and of the assembling process of the electrical contacts 30 to the base 22. Furthermore, because the resilient section 352 of each arm 35 twists in a whole when the electrical pin 42 is to be pushed into between the free ends 353, an arm of force of each arm 35 is comparatively long and the resilience of the electrical contact 30 is good, thereby reducing a push force which is needed to push the aelectrical pin 42 into between the free ends 353. In addition, as is clearly shown in FIGS. 6 and 7, there are no acute angles to be encountered in pushing the electrical pin 42 along the direction as indicated by the arrow A into between the free ends 353, so the push force is further reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ZIF socket connector adapted for electrically connecting with an electronic package having a plurality of pins, comprising:

a base defining a plurality of openings extending therethrough;

an actuator;

a cover being assembled to the base for receiving thereon an electronic package having a plurality of pins and being actuated by the actuator to be movable with respect to the base; and a plurality of electrical contacts being received in the openings of the base, each electrical contact comprising a base portion retained to the opening of the base, a solder portion extending from a first end of the base portion, and a contacting portion including a pair of arms, each arm comprising a descending section extending downwardly from a second end of the base portion opposite to the first end, a horizontal section extending forwardly from the descending section, and a resilient section extending upwardly from the horizontal section, the resilient sections of the arms of each electrical contact pressing therebetween and electrically connecting with one of the pins of the electronic package, wherein the solder portion is rectangular and and is perpendicular to the base portion, wherein the base portion of each electrical contact is formed with a plurality of barbs to engage with the opening of the base, and wherein the horizontal section extends parallelly and above the solder portion.

2. The ZIF socket connector as claimed in claim 1, wherein the cover defines a plurality of holes corresponding in number to the openings of the base and to the electrical contacts for the pins of the electronic package to extend therethrough into the openings of the base.

3. The ZIF socket connector as claimed in claim 1, wherein the resilient sections of the arms of each electrical contact has free ends defining contacting surfaces and so twisted as to have the contacting surfaces thereof facing each other and electrically contacting the pin of the electronic package therebetween.

4. An electrical contact comprising:

a vertical base portion;

a horizontal solder portion extending from a lower portion of the base portion in a first direction;

a contact portion extending from the base portion, said contact portion including:

a pair of arms spaced from each other generally in a parallel relation;

each of said arms defining a descending section downwardly extending from an upper portion of the base portion, a resilient section obliquely facing to said descending section, and a bight section connected therebetween; wherein said descending sections, the bight sections and the resilient sections of said pair of arms commonly defines a space allowing zero insertion force of a CPU pin while having said CPU pin engaged with said resilient sections of the arms after said CPU pin is moved along said first direction, and wherein said arms occupy a similar dimension as the base portion along a second direction perpendicular to said first direction after said contact is stamped from a metal sheet but not being bent.

5. The contact as claimed in claim 4, wherein the descending sections of said pair of arms are coplanar with each other.

6. The contact as claimed in claim 4, wherein the bight sections of said pair of arms are coplanar with each other.

7. The contact as claimed in claim 4, wherein said bight sections of said pair of arms are parallel to the solder portion.

* * * * *